US010953460B2

(12) United States Patent
Whitehouse et al.

(10) Patent No.: US 10,953,460 B2
(45) Date of Patent: Mar. 23, 2021

(54) METHOD OF MAKING INVESTMENT CASTING MOLD

(71) Applicant: 3M INNOVATIVE PROPERTIES COMPANY, St. Paul, MN (US)

(72) Inventors: Christopher A. Whitehouse, Greenville, TN (US); William S. Snyder, Jr., Greenville, TN (US)

(73) Assignee: 3M INNOVATIVE PROPERTIES COMPANY, Saint Paul, MN (US)

( * ) Notice: Subject to any disclaimer, the term of this patent is extended or adjusted under 35 U.S.C. 154(b) by 19 days.

(21) Appl. No.: 16/340,899

(22) PCT Filed: Oct. 6, 2017

(86) PCT No.: PCT/US2017/055472

§ 371 (c)(1),
(2) Date: Apr. 10, 2019

(87) PCT Pub. No.: WO2018/071287

PCT Pub. Date: Apr. 19, 2018

(65) Prior Publication Data

US 2019/0232362 A1 Aug. 1, 2019

Related U.S. Application Data

(60) Provisional application No. 62/406,142, filed on Oct. 10, 2016.

(51) Int. Cl.

| | |
|---|---|
| ***B22C 1/16*** | (2006.01) |
| ***B22C 1/22*** | (2006.01) |
| ***B22C 9/04*** | (2006.01) |

(52) U.S. Cl.

CPC ..... *B22C 1/165* (2013.01); *B22C 1/22* (2013.01); *B22C 9/04* (2013.01)

(58) Field of Classification Search

CPC .. B22C 1/165; B22C 1/22; B22C 7/02; B22C 9/04

See application file for complete search history.

(56) References Cited

U.S. PATENT DOCUMENTS

| | | | |
|---|---|---|---|
| 3,081,519 | A | 5/1963 | Blades |
| 3,165,799 | A | 1/1965 | Watts |

(Continued)

FOREIGN PATENT DOCUMENTS

| | | | |
|---|---|---|---|
| CN | 101811174 | A | 8/2010 |
| EP | 0013836 | | 8/1980 |

(Continued)

OTHER PUBLICATIONS

Rheolate 420 (Year: 2007).*

(Continued)

*Primary Examiner* — Kevin E Yoon
(74) *Attorney, Agent, or Firm* — Thomas M. Spielbauer

(57) ABSTRACT

Various embodiments of making an investment casting mold are disclosed. The method includes coating a sacrificial pattern with a prime layer that includes a first refractory slurry and a first refractory stucco; at least partially hardening the prime layer; and coating the prime layer with an intermediate layer that includes a second refractory slurry and a second refractory stucco. The method further includes at least partially hardening the intermediate layer; coating the intermediate layer with a first backup layer that includes a first thixotropic agent, the first thixotropic agent including a first polymer emulsion; coating the first backup layer with a second backup layer that includes a second thixotropic agent, the second thixotropic agent including a second polymer emulsion; and at least partially hardening the first backup layer and the second backup layer.

16 Claims, 5 Drawing Sheets

(56) References Cited

U.S. PATENT DOCUMENTS

| | | | | |
|---|---|---|---|---|
| 3,367,393 | A * | 2/1968 | Lenahan | B22C 23/02 164/34 |
| 3,467,744 | A | 9/1969 | Woodell | |
| 3,903,950 | A | 9/1975 | Lirones | |
| 4,019,558 | A | 4/1977 | Szabo | |
| 4,138,381 | A | 2/1979 | Chang | |
| 4,226,754 | A | 10/1980 | Yun | |
| 4,384,096 | A | 5/1983 | Sonnabend | |
| 4,421,902 | A | 12/1983 | Chang | |
| 4,668,410 | A | 5/1987 | Haas | |
| 5,021,213 | A | 6/1991 | Nishio | |
| 5,975,188 | A * | 11/1999 | Lassow | B22C 1/00 164/4.1 |
| 6,069,217 | A | 5/2000 | Nae | |
| 6,020,415 | A | 6/2000 | Guerra, Jr. | |
| 6,450,243 | B1 | 9/2002 | Shaw | |
| 6,755,237 | B2 | 6/2004 | Duffey | |
| 6,769,475 | B2 | 8/2004 | Shaw | |
| 6,814,131 | B2 | 11/2004 | Vandermeer | |
| 7,048,034 | B2 | 5/2006 | Vandermeer | |
| 8,235,092 | B2 * | 8/2012 | Scott | B22C 7/02 164/35 |
| 9,227,241 | B2 | 1/2016 | Bhattacharja | |
| 2002/0114701 | A1 * | 8/2002 | Coulson | B22C 9/04 416/241 R |
| 2004/0134634 | A1 | 7/2004 | Yang | |
| 2012/0148736 | A1 | 6/2012 | Bhattacharja | |
| 2013/0224066 | A1 * | 8/2013 | Bewlay | B22C 9/22 420/417 |

FOREIGN PATENT DOCUMENTS

| | | |
|---|---|---|
| WO | WO 2006/135452 A1 | 12/2006 |
| WO | WO 2015-168233 | 11/2015 |
| WO | WO 2018-071287 | 4/2018 |
| WO | WO 2018-085560 | 5/2018 |
| WO | WO 2019-016741 | 1/2019 |

OTHER PUBLICATIONS

Ewoldt, "Yield Stress Fluids, Meeting #1," https://nnf.mit.edu/sites/default/files/documents/sr-2009-1.pdf (Year: 2009).*

Rheological Techniques for Yield Stress Analysis, http://www.tainstruments.com/pdf/literature/RH025.pdf (Year: 2020).*

"Fibrillated Fibers", Engineered Fibers Technology, LLC, 2010. Available online at <http://www.eftfibers.com/prod_fibrillated.php>. Retrieved online Nov. 17, 2016, 1 page.

International Search report for PCT International Application No. PCT/US2017/055472 dated Dec. 15, 2017, 5 pages.

Snyder, B. and Snow, J. "*A New Combination Shell Strength and Permeability Test*," in the 51st Annual Technical Meeting of the Investment Casting Institute, 2003, p. 11:1-25 (published by the Investment Casting Institute).

* cited by examiner

METHOD OF MAKING INVESTMENT CASTING MOLD

CROSS REFERENCE TO RELATED APPLICATIONS

This application is a national stage filing under 35 U.S.C. 371 of PCT/US2017/055472, filed Oct. 6, 2017, which claims the benefit of Provisional Application No. 62/406,142, filed Oct. 10, 2016, the disclosure of which is incorporated by reference in their entirety herein.

BACKGROUND

Investment casting, sometimes referred to as a "lost wax" process, is a well-known method of manufacturing components having intricate and complex shapes. This process is used in diverse large- and small-scale applications, ranging from the manufacture of superalloy gas turbine engine components to tiny customized orthodontic appliances.

An investment casting process typically begins with the preparation of a sacrificial wax pattern having a size and shape similar to that of the device to be manufactured. This wax pattern can be made by molding, a rapid prototyping process, or any other method. The pattern then undergoes a shelling process in which it is sequentially dipped into tanks containing coating materials, typically ceramic slurries. Each layer of coating material is given time to dry before the next dip. Additionally, dry refractory granules, or stucco, can be applied between dips to enhance the structural integrity of the shell. This process is repeated over and over to gradually build up a shell having multiple ceramic layers.

After the shell is thus formed, the pattern is then heated, typically using a flash furnace or steam autoclave, to melt the wax and allow it to be extracted from the mold. The end result is a mold with a hollow cavity faithfully reproducing the shape of the pattern. At this point, the mold can be further strengthened by firing. A molten metal alloy can then be introduced into the mold cavity to cast the desired part. Finally, after the alloy has been sufficiently cooled, the mold can be mechanically or chemically disintegrated to separate the cast part from the mold.

In conventional investment casting methods, the finished shell contains six or more layers, each of which could include two or more sub-layers of slurry or stucco. The first layer, known as a prime coat, is applied directly to the wax pattern. The prime coat often includes both a refractory slurry and a refractory stucco. The next layer, known as the intermediate coat, is applied over the prime coat and also includes a refractory slurry and a refractory stucco. Following application of the prime and intermediate coats, three or more backup coats are generally applied to build up the thickness of the shell. Each backup coat also commonly includes a refractory slurry and a refractory stucco. In many cases, a final seal coat is then applied over the final backup coat to prevent stucco from coming loose from the shell during further processing of the shell.

SUMMARY

In general, the present disclosure provides various embodiments of slurry compositions that can be used to produce investment casting molds and methods of producing such molds. Such methods can include coating a sacrificial pattern with first and second backup layers that can, in one or more embodiments, fill fine details of the sacrificial pattern such as nooks, crannies, and crevices, to provide an investment casting mold having the desired specifications.

In one aspect, the present disclosure provides a method of making an investment casting mold. The method includes coating a sacrificial pattern with a prime layer that includes a first refractory slurry and a first refractory stucco; at least partially hardening the prime layer; and coating the prime layer with an intermediate layer that includes a second refractory slurry and a second refractory stucco. The method further includes at least partially hardening the intermediate layer; coating the intermediate layer with a first backup layer that includes a first thixotropic agent, the first thixotropic agent including a first polymer emulsion; coating the first backup layer with a second backup layer that includes a second thixotropic agent, the second thixotropic agent including a second polymer emulsion; and at least partially hardening the first backup layer and the second backup layer.

DEFINITIONS

Figure 1:
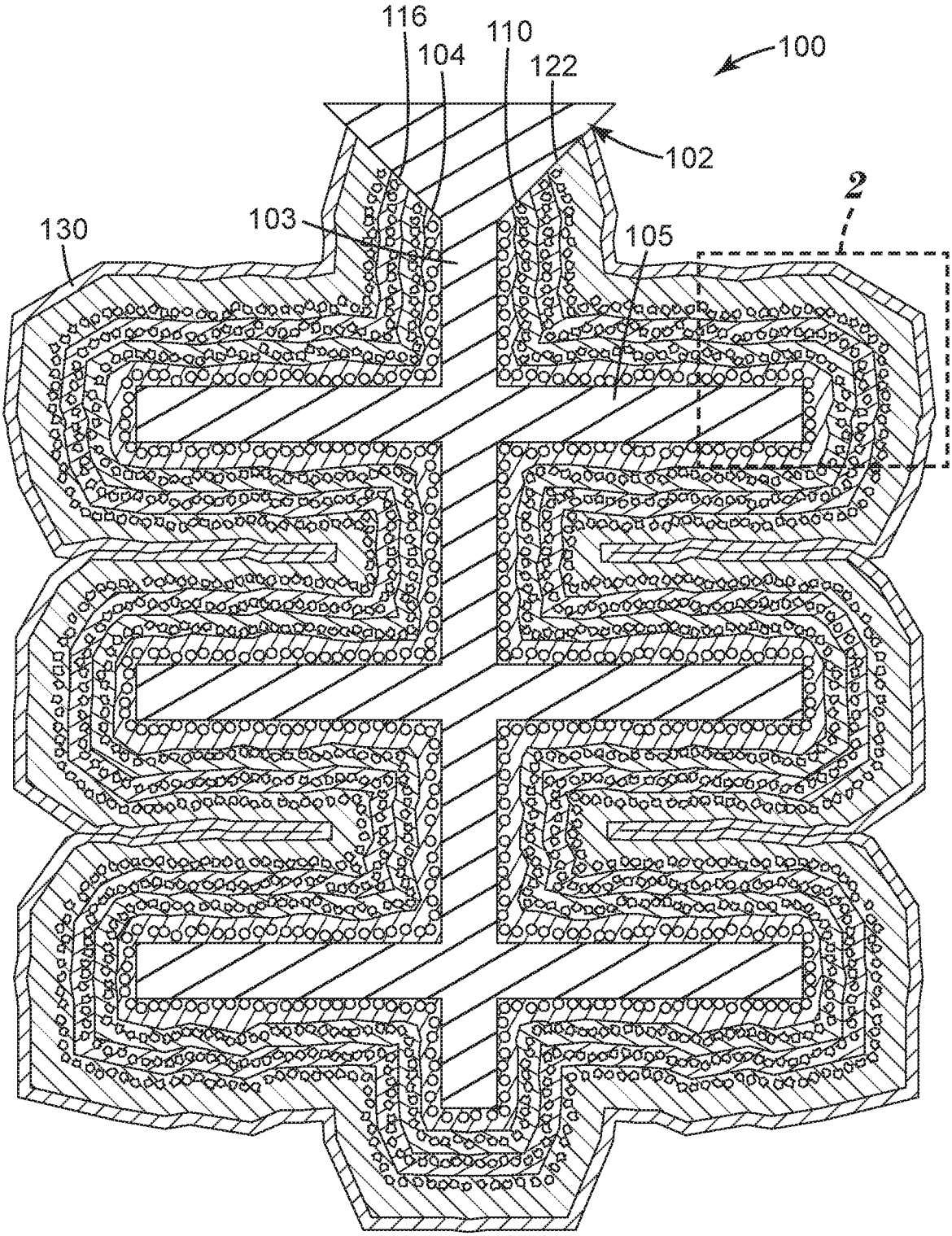
FIG. 1 is a schematic cross-section view of one embodiment of a multilayered investment casting mold.

As used herein:

"refractory" refers to a heat-resistant ceramic material;

"slurry" refers to a fluid mixture of a solid grain with a liquid;

"stucco" refers to a solid grain having a particle size usually not coarser than a U.S. sieve 30 mesh screen;

"thixotropic" refers to a shear-thinning property, where a gel or liquid becomes less viscous when it is shaken, agitated, or otherwise stressed;

"wax" refers to a polymeric substance capable of melting at low temperatures to yield a low viscosity liquid; and "zircon" refers to zirconium silicate, having the chemical formula $ZrSiO_4$.

As used herein and in the appended claims, the singular forms "a," "an," and "the" include plural referents unless the context clearly dictates otherwise. Thus, for example, reference to "a" or "the" component may include one or more of the components and equivalents thereof known to those skilled in the art. Further, the term "and/or" means one or all of the listed elements or a combination of any two or more of the listed elements.

It is noted that the term "comprises" and variations thereof do not have a limiting meaning where these terms appear in the accompanying description. Moreover, "a," "an," "the," "at least one," and "one or more" are used interchangeably herein.

Reference throughout this specification to "one embodiment," "certain embodiments," "one or more embodiments" or "an embodiment" means that a particular feature, structure, material, or characteristic described in connection with the embodiment is included in at least one embodiment of the invention. Thus, the appearances of the phrases such as "in one or more embodiments," "in certain embodiments," "in one embodiment" or "in an embodiment" in various places throughout this specification are not necessarily referring to the same embodiment of the invention. Furthermore, the particular features, structures, materials, or characteristics may be combined in any suitable manner in one or more embodiments.

DETAILED DESCRIPTION

In general, the present disclosure provides various embodiments of slurry compositions that can be used to produce investment casting molds and methods of producing such molds. Such methods can include coating a sacrificial pattern with first and second backup layers that can, in one or more embodiments, fill fine details of the sacrificial pattern such as nooks, crannies, and crevices, to provide an investment casting mold having the desired specifications.

Backup layers having greater viscosities or higher solid percentages may not flow into finer details of a sacrificial pattern, thereby forming an investment casting mold that does not include such fine details. On the other hand, the chemical and material properties of the backup layers need to be selected such that the finished investment casting mold has the required strength and durability. Utilizing backup layers that may not be of sufficient viscosity may form an investment casting mold that does have such strength and durability.

The use of two or more backup layers having differing properties (e.g., viscosities) can provide a mold that includes fine details and exhibits the required strength and durability. In one or more embodiments, a sacrificial pattern can be coated with a first backup layer, and the first backup layer can be coated with a second backup layer, (with or without application of stucco between such layers) where the first and second backup layers have different chemical and/or material properties, e.g., different viscosities. In one or more embodiments, the first backup layer can include a material that has a first viscosity that is less than a second viscosity of a material of the second backup layer, such that the first backup layer can fill fine details of the sacrificial pattern that may not be filled with backup layers having greater viscosities. Because the second viscosity of the second backup layer is greater than the first viscosity of the first backup layer, the second backup layer can displace the first backup layer in larger features of the sacrificial pattern while leaving the first backup layer within smaller features, while providing a layer that is strong and durable.

The illustrated patterns and associated sprues are exemplary, not drawn to scale, and may differ widely in size and shape depending upon the application at hand. It is further understood that the refractory materials, solvents, and binders described herein are exemplary and may be substituted or modified according to the knowledge of one skilled in the art.

While the compositions and related methods described herein enable one of skill in the art to make and use investment casting molds with certain advantageous properties, it is appreciated that these compositions and methods could be further combined with additives or enhancements not examined here. For example, slurry compositions could further include gaseous or solvent-based gelling agents, chemically treated refractory materials, and slurry binder systems that interact with one another.

Creating the aforementioned layers of the shell involves a substantial amount of time. Substantial amounts of time are involved not only in the dipping process used to apply each of the constituent slurry and/or stucco layers, but also the drying steps that follow the coating of each major layer. The large number of steps in the manufacturing process also heightens the overall risk of inadvertently inducing a defect or causing damage to the shell.

FIG. 1 is a schematic cross-section view of one embodiment of an investment casting mold 100. The mold 100 is shown encapsulating a substantial portion of a sacrificial pattern 102, which has a tree-like structure with a centrally located trunk (or down sprue) 103 and a plurality of branches 105 extending outwardly from the trunk 103. The pattern 102 is exemplary and can take any suitable shape and have any suitable dimensions.

The pattern 102 can include any suitable material or combination of materials. In one or more embodiments, the pattern 102 includes wax, polymer resin, or other suitable pattern material capable of being subsequently melted, vaporized, burned, or dissolved to leave behind, with minimal residue, a cavity conforming to the exterior contours of the pattern 102.

As shown, the mold 100 includes a series of successive layers built up by dipping the pattern 102 into containers of refractory slurry. After withdrawing the pattern 102 following each dip, excess slurry/stucco is allowed to drain off. Optionally, the pattern 102 is manipulated by hand or mechanically to promote uniform coverage. Refractory granules, or stucco, are then applied to the wet slurry coating. In one or more embodiments, the combination of slurry and stucco includes a single major layer, which is then allowed to dry and at least partially harden before the next coat is applied. By repeating this process, the walls of the mold 100 are progressively built up, layer upon layer, until the overall mold 100 has the strength to withstand the physical handling forces induced by metal casting. Beginning from the innermost layer and ending with the outermost layer, the mold 100 includes a prime layer 104, an intermediate layer 110, a first backup layer 116, a second backup layer 122, and a seal layer 130.

While the mold 100 of FIG. 1 represents a five-layered construction, additional or fewer layers may also be used depending upon the nature of the application. For example, factors such as the molten metal head pressure and the size of the casting to be poured from the final mold can influence the number of backup layers used.

Figure 2:
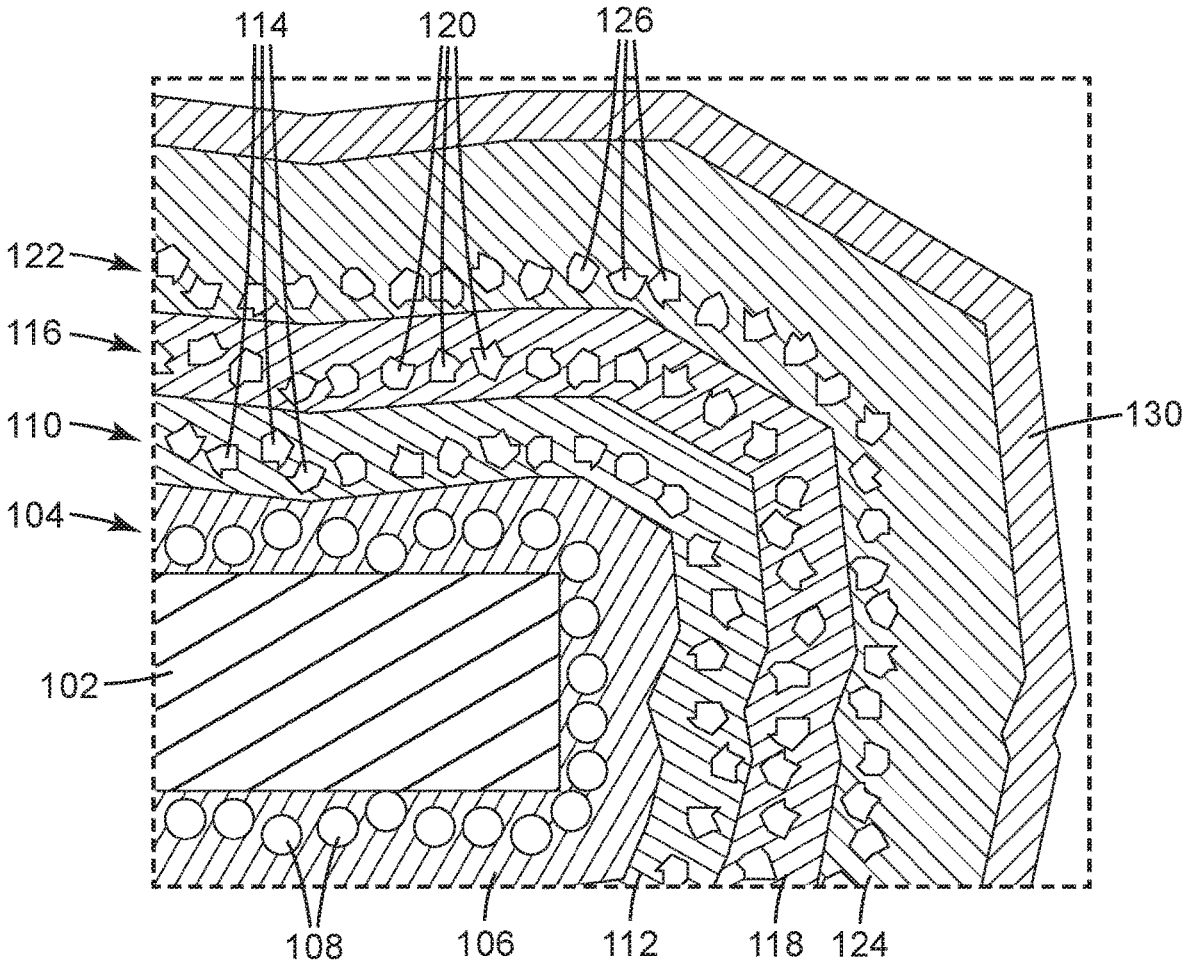
FIG. 2 is an enlarged fragmentary cross-section view of an inset portion of the investment casting mold of FIG. 1.

Each of the five layers enumerated above are described in further detail in reference to the inset illustrated in FIG. 2. The prime layer 104 is an innermost layer extending across and contacting the pattern 102. The prime layer 104 is intended to come into direct contact with molten metal after the finished mold 100 has been de-waxed and fired. As shown, the prime layer 104 includes two sub-layers: an inner layer of refractory slurry 106 and an outer layer of refractory stucco 108. In the mold 100 depicted in FIG. 2, the refractory slurry 106 and refractory stucco 108 can include any suitable material or combination of materials, e.g., zircon particles (shown here as round particles) although this need not be the case. In certain embodiments, one or more additional prime layers may be used. This may be the case, for example, where there is no intermediate slurry layer capability.

The intermediate layer 110, and successive backup layers 116 and 122 also include two sub-layers each: a layer of refractory slurry 112, 118, 124, and an adjacent layer of refractory stucco 114, 120, 126, respectively. The stucco can be applied using any suitable technique or combination of techniques, e.g., sprinkling it onto a freshly coated slurry by hand or by rainfall sander, or by immersion into a fluidized bed of stucco. In one or more embodiments, the size of the stucco particles generally increases from the inside to the outside of the mold 100.

The optional seal layer 130 can be disposed on the outermost periphery of the mold 100. In one or more embodiments, the seal layer 130 can prevent stucco 126 from the second backup layer 122 from coming loose during subsequent processing of the finished mold 100 and can have a composition identical or similar to that of the intermediate or backup slurries. The seal layer 130 can include any suitable material or combination of materials. In one or more embodiments, the seal layer 130 includes a fused silica, alumino-silicate, zircon, aluminum oxide, or a mixture thereof.

In an exemplary method, the resulting structure as shown in FIGS. 1 and 2 can then be fully dried and heated to melt the pattern 102 and remove the pattern 102 from the finished investment casting mold 100. To add greater strength, the finished mold 100 can be fired in a curing oven at any suitable temperature, e.g., at a temperature of about 980 degrees Celsius.

The intermediate layer 110 can include any suitable refractory slurry 112, e.g., fused silica, alumino-silicate, zircon, aluminum oxide, or a mixture thereof Further, the intermediate layer 110 can include any suitable refractory stucco 114, e.g., fused silica, alumino-silicate, zircon, aluminum oxide, or a mixture thereof.

The first backup layer 116 is disposed on the intermediate layer 110. In one or more embodiments, the first backup layer 116 can have a spatial thickness considerably greater than either of the prime or intermediate layers 104, 110. In one or more embodiments, the first backup layer 116 can fill in open undercuts and cavities presented by the branches of the pattern 102, thereby simplifying subsequent coating processes. The first backup layer 116 can include any suitable material or combination of materials as is further described herein. In one or more embodiments, the first backup layer 116, as shown, includes the inner coating of the refractory slurry 118 followed by the layer of refractory stucco 120.

The investment casting mold 100 also includes the second backup layer 122. The second backup layer 122 can be coated onto one or more portions of the first backup layer 116. In one or more embodiments, the second backup layer 122 can be coated onto the entire first backup layer 116. The second backup layer 122 can include any suitable material or combination of materials as is further described herein. In one or more embodiments, the second backup layer 122 includes the inner coating of the refractory slurry 124 and the layer of refractory stucco 126.

In one or more embodiments, the optional seal layer 130 can be disposed over the first backup layer 116 and the second backup layer 122. The seal layer 130 can be in contact with the second backup layer 122. Any suitable seal layer can be utilized to form seal layer 130, e.g., the same material or materials described herein regarding the first backup layer 116 and the second backup layer 122.

In one or more embodiments, each slurry layer is optionally disposed on the pattern or underlying layer using a dipping process. When a dipping process is used, the slurry for each layer can have a sufficient viscosity to be retained on the pattern or underlying layer over an acceptable working time, yet also having sufficient flowability to fill essentially all of the voids in the dipped assembly to preserve high fidelity in the mold shape. Acceptable working times generally range from about 12 seconds to about 60 seconds. The required working time for this slurry will depend upon the process and foundry but generally is the time required for the slurry to stop draining and then be moved from above the slurry pot into the stucco application area. In one or more embodiments, this time period is on the order of 2-3 minutes. These competing properties can be simultaneously achieved using the investment casting molds and methods described herein.

The investment casting mold 100 can be fabricated using any suitable layer-by-layer construction technique or combination of techniques.

Each of the first and second refractory slurries 118 and 124 of the first and second backup layers 116, 122 can have a composition that includes a refractory material, a binder, a solvent, and a thixotropic agent that includes a polymer emulsion.

The refractory material, or refractory flour or powder, is a first major component of the refractory slurry 118 of first backup layer 116 and the refractory slurry 124 of the second backup layer 122. The refractory material can include any suitable material or combination of materials, e.g., zircon ($ZrSiO_4$), silica ($SiO_2$), both fused and quartz, alumina ($Al_2O_3$), zirconia ($ZrO_2$), and alumino-silicate (various combinations of $Al_2O_3$ and $SiO_2$, commonly fired at high temperatures). In one or more embodiments, the refractory material utilized for the slurries 118, 124 and/or stuccos 120, 126 can include fused silica, alumino-silicate, zircon, aluminum oxide and mixtures thereof. The refractory powder can include any suitable particle size distribution, e.g., sizes of at least 325 F mesh and not greater than 120 F mesh. In one or more embodiments, the refractory powder can include sub-micron particle sizes.

The binder is a second major component of the first and second refractory slurries 118, 124 of the first and second backup layers 116, 122. In one or more embodiments, the binder can include a refractory binder, an organic binder, or a combination of both. Refractory binders that may be utilized in the refractory slurries 118, 124 can include a variety of ceramic materials, including silicates, alkali metal silicates, silica sols, aluminum oxychloride, aluminum phosphate, gypsum-silica mixes, cements, and mixtures thereof. In one or more embodiments, the refractory binder includes colloidal silica. Organic binders can be thermally decomposable and include polyvinyl alcohol, polyvinyl butyral, methyl cellulose, carboxymethyl cellulose, ethyl cellulose, and mixtures thereof. Exemplary binders are described, for example, in U.S. Pat. No. 3,165,799 (Watts), U.S. Pat. No. 3,903,950 (Lirones), U.S. Pat. No. 5,021,213 (Kato et al.), and U.S. Pat. No. 6,020,415 (Guerra). In one or more embodiments, the organic binder can include a mixture of colloidal sol and at least one acrylic latex polymer. The colloidal sol can be, for example, a silica sol, zirconia sol, alumina sol, or yttria sol, while the latex polymer can be an acrylic latex polymer, acrylic polymer, styrene-butadiene latex polymer, or mixture thereof.

The solvent is generally the same as the liquid dispersant used for the binder. In one or more embodiments, the solvent can include water. Many other solvents are available, however, including other polar solvents such as mineral acids, alcohols such as methanol, ethanol, isopropanol, and butanol, glycols and glycol ethers, and mixtures thereof. Commercial binders are often provided in solution form, so the step of adding a separate solvent may not be necessary.

One or both of the first and second refractory slurries 118, 124 can further include a thixotropic agent (or shear-thinning agent) that is based on a polymer emulsion. In one or more embodiments, the first backup layer 116 can include a first thixotropic agent and the second backup layer 122 can include a second thixotropic agent. The first thixotropic agent can be the same as the second thixotropic agent. In one or more embodiments, the first thixotropic agent can be different from the second thixotropic agent. In one or more embodiments, the first thixotropic layer includes a first polymer emulsion, and the second thixotropic agent includes a second polymer emulsion that is the same as or different from the first polymer emulsion. One or both of the first and second polymer emulsions can include an acrylic polymer emulsion. In one or more embodiments, the polymer emulsion can include an acrylic polymer emulsion in water.

Polymers suitable for this application may be prepared using any of a number of different synthetic routes. Alkali-swellable polymers, for example, are synthesized by copolymerizing different monomers, where at least one monomer contains a carboxyl (—COOH) functional group. These polymers may have a structure that is linear, branched or crosslinked to form a networked structure. Use of these polymers as thickening agents is described, for example, in U.S. Pat. No. 4,226,754 (Whitton et al), which discloses a polymer made by reacting an ester of methacrylic acid, methacrylic acid, and a vinyl ester of a saturated aliphatic carboxylic acid. These thickeners are often referred to as alkali-swellable thickeners because the carboxylic acid groups are sufficient to render the polymer water-soluble when neutralized with a suitable base.

In one or more embodiments, the slurry composition can include hydrophobic entities covalently bonded to the polymeric backbone. For example, polymers can be formed by reacting an ethylenically unsaturated carboxylic acid monomer, a nonionic vinyl monomer, and a vinyl surfactant ester such as an alkylphenoxypoly (ethyleneoxy) ethyl acrylate terminated on one end with an alkyl phenyl group. Another example derives from a reaction product of an unsaturated carboxylic acid, alkyl (meth)acrylate, and an ester containing an alkyl phenyl group, where the alkyl group has 8 to 20 carbon atoms. These water-soluble polymers modified with hydrophobic moieties are described in U.S. Pat. No. 4,384,096 (Sonnabend) and U.S. Pat. No. 4,138,381 (Chang et al).

In one or more embodiments, the slurry composition for one or both of the first and second backup layers 116, 122 can include an acrylic emulsion copolymer that is prepared using emulsion copolymerization of monomers falling within three of four classes of monomers, namely (meth) acrylic acid, alkyl (meth)acrylate, an ethoxylated ester of (meth)acrylic acid having a hydrophobic group and, optionally, a polyethylenically unsaturated monomer. In one or more embodiments, the slurry composition can include an emulsion copolymer based on the reaction product of monomers including methacrylic acid, ethyl acrylate, optionally a defined copolymerizable ethylenically unsaturated monomer, and a small weight percent of a polyethylenically unsaturated monomer. Advantageously, a wide range of surfactants can enhance the thickening effect on the composition when added to an aqueous system containing the copolymer when the emulsion copolymer is neutralized. The aforementioned copolymers are further described in European Patent No. 13,836 (Chang et al.) and U.S. Pat. No. 4,421,902 (Chang et al.).

In one or more embodiments, an alkali-swellable copolymer is synthesized as the reaction product of an ethylenically unsaturated carboxylic acid, a surface-active unsaturated ester, methacrylic acid esters or acrylic acid esters of aliphatic alcohols, and optionally one or more other ethylenically unsaturated comonomers, polyethylenically unsaturated compounds, and molecular weight regulators. The surface-active ester is terminated at one end with an aliphatic radical, which may be linear or branched, a mono-, di- or tri-alkyl phenyl radical with alkyl groups of 4 to 12 carbon atoms, or a block-copolymeric radical. On partial or complete neutralization, the copolymer becomes water-soluble or colloidally dispersible, and can be used as a thickening agent. These copolymers are also described in U.S. Pat. No. 4,668,410 (Engel et al.).

One or both of the first and second thixotropic agents can include a polymer emulsion based on hydrophobically modified ester of methacrylic acid available from Elementis Specialties in Hightstown, N.J. under the tradename RHEOLATE. Methods of making such polymer emulsions are described in detail, for example, in U.S. Pat. No. 6,069,217 (Nae et al.).

Further, one or both first and second thixotropic agents can include an aqueous hydrophobically modified alkali-soluble emulsion derived from an acrylic polymer and having about 30% solids by weight, also available from Elementis Specialties in Hightstown, N.J. under the tradename RHEOLATE. Typically, this acrylic emulsion has a pH value of less than about 5.

The polymer emulsion can be present in an amount that increases the yield stress of the refractory slurry. In one or more embodiments, the polymer emulsion is present in an amount of at least 0.02 weight percent, at least 0.03 weight percent, at least 0.05 weight percent, at least 0.06 weight percent, or at least 0.07 weight percent, based on the overall weight of the composition. In one or more embodiments, the polymer emulsion is present in an amount of at most 1 weight percent, at most 0.9 weight percent, at most 0.8 weight percent, at most 0.75 weight percent, or at most 0.7 weight percent, based on the overall weight of the composition.

Using a polymer emulsion as a thixotropic agent can allow the refractory slurry to be operated within a shear stress regime that is much lower than that of the prior art while achieving a similar working viscosity for investment casting. In one or more embodiments, the slurry composition displays a working viscosity of about 20 poise when subjected to a shear stress of at least 1 dyne per square centimeter, of at least 5 dynes per square centimeter, of at least 10 dynes per square centimeter, of at least 20 dynes per square centimeter, of at least 50 dynes per square centimeter, at least 100 dynes per square centimeter, at least 200 dynes per square centimeter, or at least 400 dynes per square centimeter, as measured using the method described in the Examples.

In one or more embodiments, the same composition displays a working viscosity of about 20 poise when subjected to a yield stress in shear of at most 1000 dynes per square centimeter, at most 950 dynes per square centimeter, at most 900 dynes per square centimeter, at most 850 dynes per square centimeter, or at most 800 dynes per square centimeter.

Investment casting shells generally have large porosity as a result of the stuccoing process, which can adversely affect strength. For the strength to be deemed adequate for a given application, it must be capable of withstanding potentially high internal pressure and thermal stress, especially during the de-waxing process and when pouring metal into the free standing ceramic shell. Cracking can occur when the stress on the mold is greater than the modulus of rupture of the mold material. In one or more embodiments, the investment casting mold has a non-fired modulus of rupture of at least 150 psi (1.03 MPa), at least 175 (1.20 MPa), at least 200 psi (1.38 MPa), at least 225 (1.55 MPa), or at least 250 psi (1.72 MPa), after being fully hardened, as measured utilizing ASTM C674-88 (2006). In one or more embodiments, the investment casting mold has a non-fired modulus of rupture of at most 750 psi (5.17 MPa), at most 735 (5.07 MPa), at most 725 psi (5.00 MPa), at most 710 (4.89 MPa), or at most 700 psi (4.83 MPa), after being fully hardened.

In one or more embodiments, refractory slurries 118, 124 of the first and second backup layers 116, 122 can further include an aluminum phyllosilicate clay. In one or more embodiments, the aluminum phyllosilicate clay is present in an amount ranging from a weight ratio of at least 1:15, at least 1:10, at least 1:8, at least 1:7, or at least 1:6, relative to that of the polymer emulsion. In one or more embodiments, the aluminum phyllosilicate clay is present in an amount ranging from a weight ratio of at most 6:1, at most 5:1, or at most 4:1, relative to that of the polymer emulsion.

Combining a thixotropic thickener that includes a polymer emulsion, particularly an acrylic emulsion, with an aluminum phyllosilicate clay was observed to provide certain synergistic effects in the investment mold. For example, inclusion of both the polymer emulsion thickener and the aluminum phyllosilicate clay in the backup slurry composition was observed to substantially increase the working time of the slurry as compared with including only the aluminum phyllosilicate as thickener. When the aluminum phyllosilicate clay was used on its own, the backup slurry tended to continue to drain off of the pattern. Moreover, in one or more embodiments, inclusion of both the polymer emulsion and the aluminum phyllosilicate clay may be advantageous over including the polymer emulsion alone because the latter tended to produce slurries that were too viscous. Such high viscosities in turn can cause delicate patterns to crack or break when inserted into the slurry. In sum, the combination of a polymer emulsion thickener and an aluminum phyllosilicate clay provided an unexpected and advantageous balance of flowability along with a long working time.

There are no particular restrictions on the overall solids present in the refractory slurries 118, 124, but this measure can fall within a range sufficient to enable a stable colloidal suspension and yield a robust final investment casting mold 100. In one or more embodiments, one or both of the refractory slurries 118, 124 can have an overall solids content of at least 45 weight percent, at least 50 weight percent, or at least 55 weight percent, based on the overall weight of the composition. In one or more embodiments, one or both of the refractory slurries 118, 124 can have an overall solids content of at most 85 weight percent, at most 80 weight percent, or at most 75 weight percent, based on the overall weight of the composition. In one or more embodiments, the first backup layer 116 can have an overall solids content that is equal to the overall solids content of the second backup layer 122, greater than the overall solids content of the second backup layer, or less than the overall solids content of the second backup layer.

As mentioned herein, the composition of the first backup layer 116 can include the same composition as the second backup layer 122 or a different composition. Further, the material properties of the first backup layer 116 can be the same as the material properties of the second backup layer 122 or can include different material properties. For example, the first backup layer 116 can have a first viscosity at the onset of flow, and the second backup layer 122 can have a second viscosity at the onset of flow. The first viscosity can be the same as the second viscosity. In one or more embodiments, the first viscosity is less than the second viscosity. In one or more embodiments, the first viscosity is greater than the second viscosity. In one or more embodiments, the first viscosity is equal to at least 0.1 times the second viscosity and no greater than 0.7 times the second viscosity.

Any suitable technique or combination of techniques can be utilized to determine the relationship between the first and second viscosities of the first backup layer 116 and the second backup layer 122 respectively after the investment casting mold 100 has been formed. For example, a completed investment casting mold can be cross-sectioned and analyzed utilizing any suitable technique or combination of techniques, e.g., scanning electron microscopy (SEM). In one or more embodiments, SEM analysis can differentiate between the first backup layer 116 and the second backup layer 122 as the first backup layer can exhibit-different particle-to-particle spacing than that of the second backup layer.

Exemplary slurry compositions for the first backup layer 116 and the second backup layer 122, at the onset of flow, can display a viscosity at the onset of flow of at least 50 poise, at least 100 poise, at least 200 poise, at least 500 poise, or at least 1000 poise. In the same or alternative embodiments, the viscosity of the slurry composition at the onset of flow can be at most 7000 poise, at most 8000 poise, at most 9000 poise, at most 10000 poise, or at most 12,000 poise.

Further, the first backup layer 116 can include a first yield stress and the second backup layer 122 can include a second yield stress. The first yield stress can be equal to the second yield stress. In one or more embodiments, the first yield stress can be less than the second yield stress. Further, in one or more embodiments, the first yield stress can be greater than the second yield stress. In one or more embodiments, the first yield stress and the second yield stress can include any suitable values, e.g., at least 0.2 dynes/cm$^2$, at least 0.5 dynes/cm$^2$, at least 1 dyne/cm$^2$, at least 5 dynes/cm$^2$, or at least 10 dynes/cm$^2$. In one or more embodiments, the first yield stress and the second yield stress can be at most 200 dynes/cm$^2$, at most 250 dynes/cm$^2$, at most 500 dynes/cm$^2$, at most 750 dynes/cm$^2$, or at most 1000 dynes/cm$^2$.

Ideally, an investment casting slurry composition displays a yield stress that is sufficient to prevent excessive drainage of the slurry from a pattern after the pattern is withdrawn from a bath of the slurry. This characteristic should be tempered, however, by its flowability—essentially, its ability to flow into and around complex pattern geometries, including narrow cavities, when the pattern is dipped into the slurry. The slurry compositions provided herein operate in a solid-like regime at the low shear rates associated with gravity, but operate in a liquid-like regime at higher shear rates associated with dipping the pattern into a bath of the slurry. By minimizing gravity-induced drainage while simultaneously achieving good flowability in the dipping process, the provided compositions reduce the number of required dips while preserving the fidelity of the final molded product.

The mold 100 can be formed using any suitable technique or combination of techniques. In one or more embodiments, the sacrificial pattern 102 can be coated with the prime layer 104, which includes the first refractory slurry 106 and the first refractory stucco 108. In one or more embodiments, the prime layer 104 can be at least partially hardened using any suitable technique or combination of techniques. The prime layer 104 can be coated with the intermediate layer 110, which includes the second refractory slurry 112 and the second refractory stucco 114. In one or more embodiments, the intermediate layer 110 can be at least partially hardened using any suitable technique or combination of techniques. The intermediate layer 110 can be coated with the first backup layer 116, which includes the first thixotropic agent including the first polymer emulsion. In one or more embodiments, the first backup layer 116 can be at least partially hardened prior to coating of the second backup layer 122 using any suitable technique or combination of techniques.

The first backup layer 116 can be coated with the second backup layer 122, which includes the second thixotropic agent including the second polymer emulsion. In one or more embodiments, one or both of the first backup layer 116 and the second backup layer 122 can be at least partially hardened. Prior to at least partially hardening the second backup layer 122, the layer of refractory stucco 126 can be applied to the second backup layer.

Further, the first backup layer 116 can include a first density and the second backup layer 122 can include a second density. Further, the first backup layer 116 can include a first porosity and the second backup layer 122 can include a second porosity. Further, the first backup layer 116 can include a first pore size distribution and the second backup layer 122 can include second pore size distribution.

Figure 3:
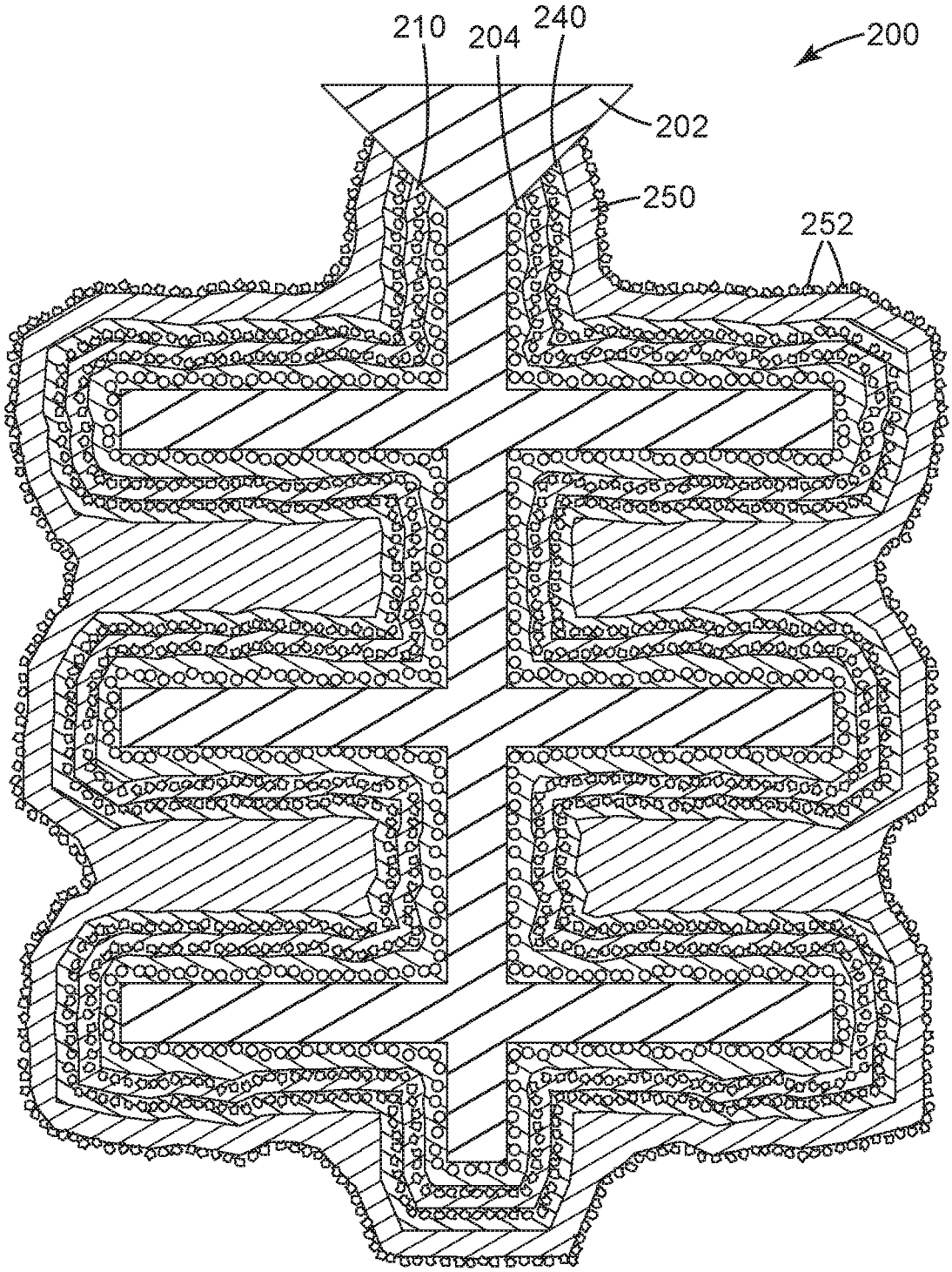
FIG. 3 is a schematic cross-section view of another embodiment of a multilayered investment casting mold.
Figure 4:
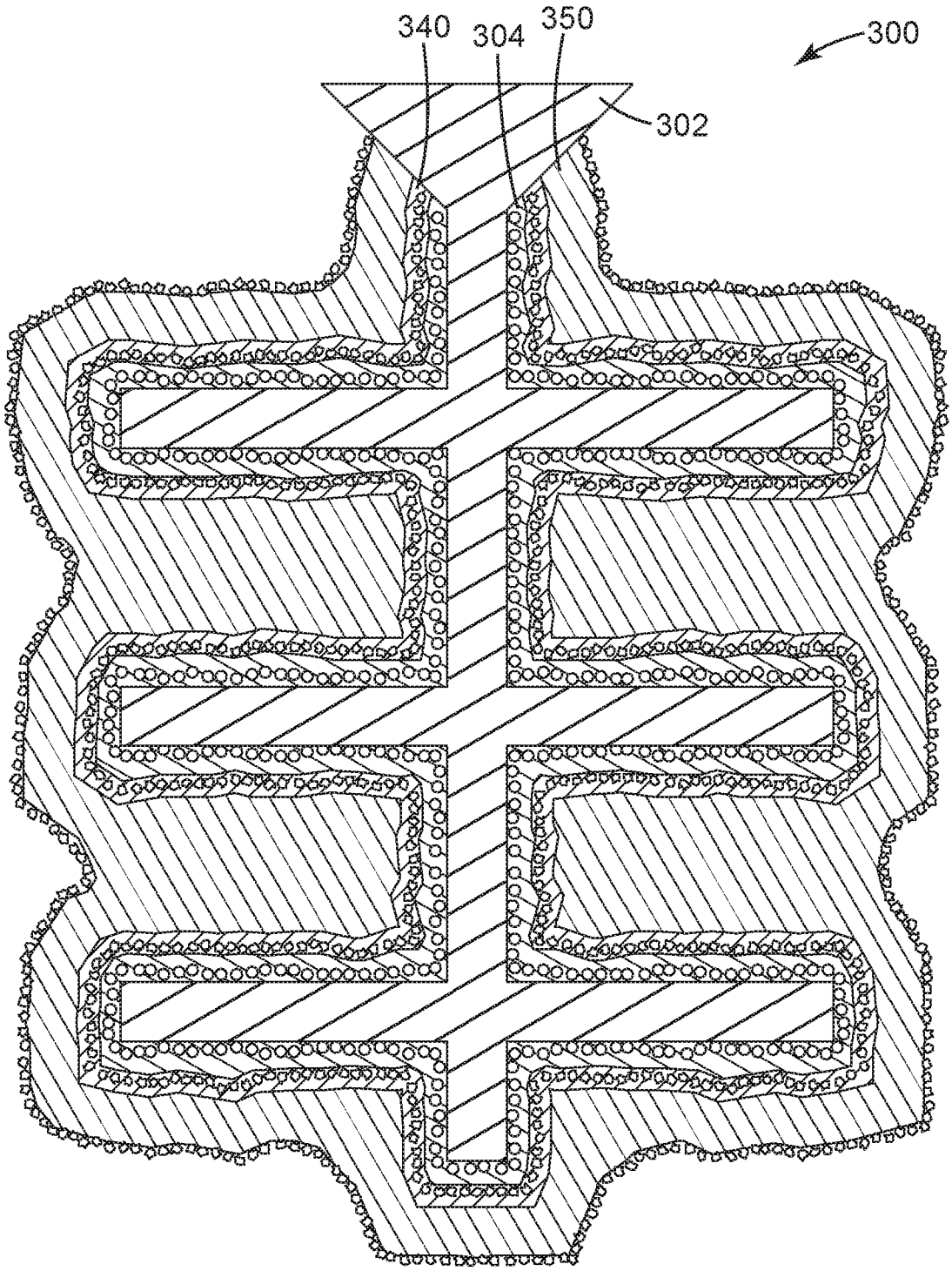
FIG. 4 is a schematic cross-section view of another embodiment of a multilayered investment casting mold.

Alternative embodiments are shown in FIGS. 3-4. FIG. 3 depicts an investment casting mold 200 according to another embodiment in which an outermost seal layer is omitted. This four-layered construction includes a prime layer 204 extending across and contacting a sacrificial pattern 202, an intermediate layer 210 extending across and contacting the prime layer, a first backup layer 240 extending across and contacting the intermediate layer 310, and a second backup layer 250 extending across and contacting the first backup layer. All of the design considerations and possibilities regarding the mold 100 of FIG. 1 apply equally to the mold 200 of FIG. 3. In one or more embodiments, each of the layers 204, 210, 240, 250 includes an inner sub-layer of refractory slurry adjoining an outer sub-layer of a refractory stucco.

Absent from the mold 200 is an outermost seal layer; in FIG. 3, the layered construction ends with refractory stucco 252 for the second backup layer 250. While sharing most of the functional properties of the mold 100, the mold 200 requires even fewer processing steps to fabricate.

FIG. 4 illustrates an investment casting mold 300 according to yet another embodiment. Compared with prior embodiments, the mold 300 is notably even further simplified in its three-layered construction. All of the design considerations and possibilities regarding the mold 100 of FIG. 1 apply equally to the mold 300 of FIG. 4. The mold 300 includes a prime layer 304, a first backup layer 340 disposed on a pattern 302, and a second backup layer 350 disposed on the first backup layer. One difference between the mold 300 and mold 100 is that mold 300 does not include an intermediate layer or a seal layer.

EXAMPLES

Materials

"WDS II", fused silica flour was obtained from 3M Midway, Midway, Tenn., under the trade designation "WDS II".

"Min-Sil 120F", fused silica flour, was obtained from 3M Midway, Midway, Tenn., under trade designation "Min-Sil 120F".

"NALCO 1130", silica sol, 30 weight % $SiO_2$, 8 nanometer particle size, was obtained from Nalco Chemical Company, Naperville, Ill., under trade designation "NALCO 1130".

"NALCO 6300", a styrene-butadiene latex polymer, 50 weight % solids, was obtained from Nalco Chemical Company, Naperville, Ill., under trade designation "NALCO 6300".

"Minco HP", a styrene butadiene latex polymer, 50 weight % solids, was obtained from 3M Midway, Midway, Tenn., under trade designation "Minco HP".

"NALCO 2305", antifoam additive containing a blend of silicones and polyglycols in a hydrocarbon solvent, was obtained from Nalco Chemical Company, Naperville, Ill., under trade designation "NALCO 2305".

"NALCO 8815", a wetting agent, was obtained from Nalco Chemical Company, Naperville, Ill., under trade designation "NALCO 8815".

"BENTONE EW", highly beneficiated, easily dispersible powdered clay thickener, was obtained from Elementis, Specialties, Inc., Hightstown, N.J., under trade designation "BENTONE EW".

"RHEOLATE 420", an alkali swellable thickener, was obtained from Elementis, Specialties, Inc., Hightstown, N.J., under trade designation "RHEOLATE 420".

"RHEOLATE 288", a highly efficient polyether polyurethane associative thickener, was obtained from Elementis, Specialties, Inc., Hightstown, N.J., under trade designation "RHEOLATE 288".

"RHEOLATE 1", an acrylic thickener with high thickening efficiency, was obtained from Elementis, Specialties, Inc., Hightstown, N.J., under trade designation "RHEOLATE 1".

"RHEOLATE 278", a highly efficient polyether polyurethane associative thickener, was obtained from Elementis, Specialties, Inc., Hightstown, N.J., under trade designation "RHEOLATE 278".

"SOLTHIX A300", an alkali swellable thickener, was obtained from Lubrizol Advanced Materials, Inc., Brecksville, Ohio, under trade designation "SOLTHIX A300".

"SOLTHIX A100", an alkali swellable thickener, was obtained from Lubrizol Advanced Materials, Inc., Brecksville, Ohio, under trade designation "SOLTHIX A100".

"THIXATROL PLUS", an active, seed resistant organic rheological additive, was obtained from Elementis, Specialties, Inc., Hightstown, N.J., under trade designation "THIXATROL PLUS".

Fused silica, 50×100 mesh (finer than U.S. Sieve 50 mesh but coarser than U.S. Sieve 100 mesh), was obtained from 3M Midway, Midway, Tenn.

Fused silica, 30×50 mesh (finer than U.S. Sieve 30 mesh but coarser than U.S. Sieve 50 mesh), was obtained from 3M Midway, Midway, Tenn.

General Method for Preparing Prime Slurry, Intermediate Slurry, and Backup Slurry Into a sufficient volume container, de-ionized (DI) water and NALCO 1130 silica sol were added. While mixing using a INDCO Model HS120T mixer (2 horsepower, 220 V, single phase motor, set at a speed of 2050 rpm), desired amounts of silica flour, additives such as polymeric binders (e.g., styrene-butadiene latex), antifoam and/or wetting agents were added and mixing was continued until all the lumps were dispersed. Finally, if desired, a rheological additive (i.e., a thixotropic agent) was added and mixing was continued, typically for less than 5 minutes.

General Method for Preparing Investment Casting Molds

Investment casting molds were made using a multi-step process. First, a wax pattern having the shape of final investment cast parts was provided. On top of the wax pattern, investment cast molds were formed by building a series of shells (i.e., layers) sequentially. In a first step, the wax pattern was coated by a "prime layer," which includes an initial coating of prime slurry layer that was further coated with a prime stucco layer. The prime slurry layer was formed by dipping the wax pattern in the prime slurry for about 20 seconds while rotating and moving the wax pattern to maximize the uniformity of the prime slurry layer. A prime stucco layer was then deposited on the wet prime slurry layer by exposing the wax pattern with the prime slurry layer thereon to a fluidized bed of 50×100 mesh zircon particles. The wax pattern with the prime stucco layer was then dried at 21 degrees Celsius for about 2 hours.

Afterwards, the wax pattern with the dried prime layer was coated with an "intermediate layer" in essentially the same manner as the prime layer except by using an intermediate slurry and stucco layers and dried. The intermediate stucco layer was formed using a fluidized bed of 50×100 mesh fused silica particles. The composition of the intermediate slurry could be the same or different than the primary slurry.

The resulting pattern was then coated with a first backup layer and a second backup layer using essentially the same techniques as those used for the primary and intermediate layers except using backup slurry and stucco layers. The backup stucco layers were formed using a fluidized bed of 30×50 mesh fused silica particles. The composition of the backup slurries could be the same or different than the primary and intermediate slurries. Finally, the pattern with sufficiently thick first and second backup layers was coated with a seal layer by dipping it again into the second backup slurry and drying. The final investment casting molds were freed of the wax pattern, fired, and used for testing and/or preparing final investment cast parts.

Example and Comparative Example investment casting molds, prepared as above, were characterized in their "green" states and/or after firing.

Method for Measuring Viscosity

Viscosity and shear stress data for slurries were measured using an AR G2 stress controlled rheometer (TA Instruments, New Castle, Del.) outfitted with a 40-mm diameter parallel plate fixture. Measurements were made using a gap of 1 mm and an operating temperature of 23 degrees Celsius.

Slurries were tested using a continuous flow shear rate sweep. Tests were conducted with an ascending shear rate from $10^{-3}$ $s^{-1}$ to 100 $s^{-1}$, and then descending shear rate down to $10^{-3}$ $s^{-1}$. The yield stress of each slurry was obtained by plotting shear stress as a function of total strain for ascending shear rates, identifying regimes of fluid-like and solid-like behavior along the plot, fitting a power law to each regime, then determining shear stress at the intersection point between these fits. The viscosity at the onset of flow was also determined based on the measured viscosity at the time yield stress was first reached.

Method for Determining the Bend Strength

To prepare strength testing samples, standard stainless steel bars 1 in.×0.25 in.×13 in. (2.54 cm×0.64 cm×33 cm) were covered with investment casting shells prepared from slurries used in Example and Comparative Examples in the same manner as preparing the investment cast molds described above. Before coating with the investment casting shells, the steel bars were first coated with wax (S.C. Johnson's Paste Wax, commercially available from S.C. Johnson & Sons, Inc., Racine, Wis.). The resulting shells were separated from the steel plates and were used for bend strength testing. The strength testing of the shell samples was carried out using a Universal Test Machine (Model SSTM-1, obtained from United Test Machine of Huntington Beach, Calif.) using a cross head speed of 0.05 in. (0.13 cm) per minute along with a 2 in. (5 cm) span. The thickness of the test samples at break was measured in six locations across the break, three on either side of the break and the measurements averaged. The width was measured twice and the measurements averaged. The strength test data reported was average of 24 test samples for the Example and each Comparative Example investment cast mold compositions. The strength data for the Example sample was run along with the corresponding Comparative Example samples. The strength test data e.g., modulus of rupture (MOR), modulus of elasticity (MOE), and load at failure were determined. The strength testing was done in the green and fired states under variety of environmental conditions.

Method for Permeability and Burst Testing

For this test, samples were prepared by building shells using the slurries prepared according to the Example and Comparative Examples, on polyvinylchloride (PVC), schedule 40 cold plumbing pipes. The PVC pipes had 0.75 in. (1.09 cm) inner diameter and 1.05 in. (2.77 cm) outer diameter and were 13 in. (33 cm) long. The pipes were first coated with wax (S.C. Johnson's Paste Wax). After the shells were built, the resulting samples were cut into 6 in. (15.2 cm) long sections for testing. The permeability and burst testing was done using the method described in Snyder, B. and Snow, J. "*A New Combination Shell Strength and Permeability Test,*" in the 51$^{st}$ Annual Technical Meeting of the Investment Casting Institute, 2003, p. 11:1-25 (published by the Investment Casting Institute). Ten sections (i.e., samples) were tested for the Example and Comparative Examples.

Comparative Example 1

CE-1

A CE-1 investment cast mold was prepared using the general method for preparing investment casting molds described above. The compositions of the, prime, intermediate, backup, and seal slurry layers used for preparing CE-1 investment cast mold was the same and the slurry was prepared as described in the general method of preparing prime-slurry, intermediate slurry, and backup slurry described above by mixing 13,705 g of WDS II silica flour, 4,516 g of NALCO 1130, 934 g DI water, 498 g Minco HP latex binder, and 21 g NALCO 2305 antifoam additive.

A wax pattern was coated with a prime layer, which included an initial coating of prime slurry layer that was further coated with a prime stucco layer of zircon. The prime slurry layer was formed by dipping the wax pattern in the prime slurry for about 20 seconds while rotating and moving the wax pattern to maximize the uniformity of the prime slurry layer. A prime stucco layer was then deposited on the wet prime slurry layer by exposing the wax pattern with the prime slurry layer thereon to a rainfall sander for application of zircon stucco. The wax pattern with the prime stucco layer was then dried at 21 degrees Celsius for about 2 hours.

Afterwards, the wax pattern with the dried prime layer was coated with a WDSII slurry layer followed by a stucco layer, which was applied using a fluidized bed of 50×100 mesh fused silica particles. This comprised the intermediate layer.

A backup layer of WDSII slurry was then coated onto the intermediate layer. A 30×50 mesh stucco was applied to the backup layer to form the first backup layer. Second and third backup layers having the same composition as the backup layer were then applied to the backup layer.

Comparative Example 2

CE-2

A CE-2 investment cast mold was prepared using the general method for preparing investment casting molds described above. CE-2 was prepared in the same manner as CE-1 as described above except for the backup layer.

The CE-2 backup layer slurry was prepared as described in the general method for preparing prime slurry, intermediate slurry, and the backup slurry described above by mixing 13500 g of Min-Sil 120F fused silica flour, 45 g of BENTONE EW, 6724 g of NALCO 1130, 952 g DI water, 328 g styrene-butadiene latex binder, and 60 g RHEOLATE 475 rheological additive (thixotrope). A backup layer was applied followed by a 30×50 mesh fused silica stucco layer.

Finally, after drying the resulting CE-2 mold for 18-24 hours, a seal layer was applied to the mold (also known as a cover coat). The composition of the seal layer slurry was the same as the prime/intermediate layers.

Example 1

EX-1

An EX-1 investment cast mold was prepared using the general method for preparing investment casting molds in the same manner as the CE-1 and CE-2 described above except for the backup layer.

To prepare the EX-1 mold, a first backup layer was coated onto the intermediate layer. The first backup layer slurry was made by mixing 14623 g of Min-Sil 120F fused silica flour, 49 g of BENTONE EW, 8011 g of NALCO 1130, 1135 g DI water, 390 g styrene-butadiene latex binder, and 65 g RHEOLATE 475 rheological additive (thixotrope).

This was followed by a 30×50 mesh fused silica stucco layer.

A second backup layer was then coated onto the first backup layer. The second backup layer was made by mixing 13500 g of Min-Sil 120F fused silica flour, 45 g of BENTONE EW, 6724 g of NALCO 1130, 952 g DI water, 328 g styrene-butadiene latex binder, and 60 g RHEOLATE 475 rheological additive (thixotrope). This was followed by a 30×50 fused silica stucco layer.

Finally, after drying the resulting EX-1 mold for 18-24 hours, a seal layer was applied to the mold (also known as a cover coat). The composition of the seal layer slurry was the same as the second backup layer above.

The percent latex, colloidal composition, and solids for the first and second backup layers are shown in Table 1 below.

TABLE 1

| | First Backup Layer | Second Backup Layer |
|---|---|---|
| % Latex | 4.1 | 4.1 |
| % Colloidal | 25 | 25 |
| % solids | 60 | 63 |

The CE-1, CE-2 and EX-1 formulations were used to prepare sufficient numbers of molds for permeability, burst, and strength testing under a variety of test conditions as described below. Final drying time from seal dip application to permeability/burst/green MOR and hot wet MOR was 18 hrs.

Sample preparation and testing was carried out using the procedures described above. Test results obtained are described below.

Shell Permeability and Burst Strength

CE-1, CE-2 and EX-1 samples prepared for strength testing and permeability testing were used to determine the thickness of the shells built for each formulation. Table 2, below, summarizes the permeability and the maximum tangential hoop stress for CE-1, CE-2, and EX-3 obtained using the methods described above.

TABLE 2

| | Strength test samples | | Max. Tangential Hoop Stress Test | |
|---|---|---|---|---|
| Example | Permeability ($cm^2$) | 95% Standard error ($cm^2$) | Maximum tangential stress (MPa) | 2X 95% Standard error (MPa) |
| CE-1 | $3.6 \times 10^{-10}$ | $2.2 \times 10^{-11}$ | 0.36 | 0.021 |
| CE-2 | $4.7 \times 10^{-10}$ | $4.4 \times 10^{-11}$ | 0.15 | 0.016 |
| EX-1 | $5.4 \times 10^{-10}$ | $3.4 \times 10^{-11}$ | 0.30 | 0.015 |

Shell Thickness

The shells were invested on flat 1"×14" (2.5 cm×36 cm) stainless steel bars and ¾" (1.9 cm) PVC pipes. MOR sample shell thickness was recorded and is shown in Table 3, where the EX-1 shell was approximately 20% thinner than the CE-2 shell.

TABLE 3

| Example | Shell Thickness (cm) | 95% Standard error (cm) |
|---|---|---|
| CE-1 | 0.61 | .02 |
| CE-2 | 0.73 | .03 |
| EX-1 | 0.72 | .04 |

Pipe shell thicknesses are depicted in Table 4 below, where again the PVC pattern demonstrated a similar decrease in shell thickness as the MOR substrate did above.

TABLE 4

| Example | Shell Thickness (cm) | 2 × 95% Standard error (cm) |
|---|---|---|
| CE-1 | 0.64 | .02 |
| CE-2 | 0.69 | .02 |
| EX-1 | 0.76 | .03 |

Green Shell Properties

Shell samples were tested in the unfired/ green state using the method described above. Table 5 demonstrates that in the green (unfired, dried only) state, the CE-2 shell and the EX-1 shell have a similar strength. Table 5 includes data for the Modulus of Rupture (MOR), the Modulus of Elasticity (MOE) and the Failure Load for the molds in the green state, with 24 samples per group. The rigidity in the green state between the CE-2 and the EX-1 shells was very similar. Further, the load required for shell failure for the EX-1 mold was lower than that of the CE-2 mold.

TABLE 5

| Example | MOR/95% Standard error (MPa) | MOE/95% Standard error (MPa) | Failure Load/95% Standard error (kg) |
|---|---|---|---|
| CE-1 | 4.08/0.14 | 1670/124 | 3.6/0.4 |
| CE-2 | 3.33/0.26 | 1689/268 | 3.2/0.2 |
| EX-1 | 3.92/0.33 | 1821/228 | 4.5/0.0 |

Hot/Wet Shell Testing

Shell samples were then tested "Hot/Wet" after boiling for 15 minutes using the method described above. Table 6 below illustrates the MOR, MOE, and failure load for the molds under hot/wet testing. Table 6 shows a sizable 64% increase in strength in this hot-wet state for the EX-1 mold.

TABLE 6

| Example | MOR/95% Standard error (MPa) | MOE/95% Standard error (MPa) | Failure Load/95% Standard error (kg) |
|---|---|---|---|
| CE-1 | 1.44/0.13 | 806/90 | 1.3/0.1 |
| CE-2 | 1.15/0.15 | 618/111 | 1.2/0.2 |
| EX-1 | 1.58/0.17 | 746/99 | 1.8/0.1 |

Fired Cold Shell Properties

Knockout-type properties were estimated after firing MOR bar shell samples to 2000° F., holding for 2 hours and allowing to furnace cool.

Table 7 below summarizes the fired (after cooling to room temperature) strength test data for CE-1, CE-2, and EX-1, obtained using the method described above.

TABLE 7

| Example | MOR/95% Standard error (MPa) | MOE/95% Standard error (MPa) | Failure Load/95% Standard error (kg) |
|---|---|---|---|
| CE-1 | 1.79/0.07 | 572/55 | 1.4/0.1 |
| CE-2 | 1.64/0.13 | 889/115 | 1.6/0.1 |
| EX-1 | 1.82/0.22 | 669/84 | 2.3/0.2 |

Fired-Hot Shell Properties

Table 8 summarizes the fired (and tested while hot) strength test data for CE-1, CE-2, and EX-1, prepared using the method described above. Shell strength was tested after firing the molds at 2000° F. for two hours and broken while still hot.

TABLE 8

| Example | MOR/95% Standard error (MPa) | MOE/95% Standard error (MPa) | Failure Load/95% Standard error (kg) |
|---|---|---|---|
| CE-1 | 9.14/0.48 | 4468/379 | 7.7/0.6 |
| CE-2 | 7.60/0.79 | 3965/726 | 7.3/0.5 |
| EX-1 | 8.74/0.55 | 3902/498 | 11.2/1.0 |

Viscosities

Figure 5:
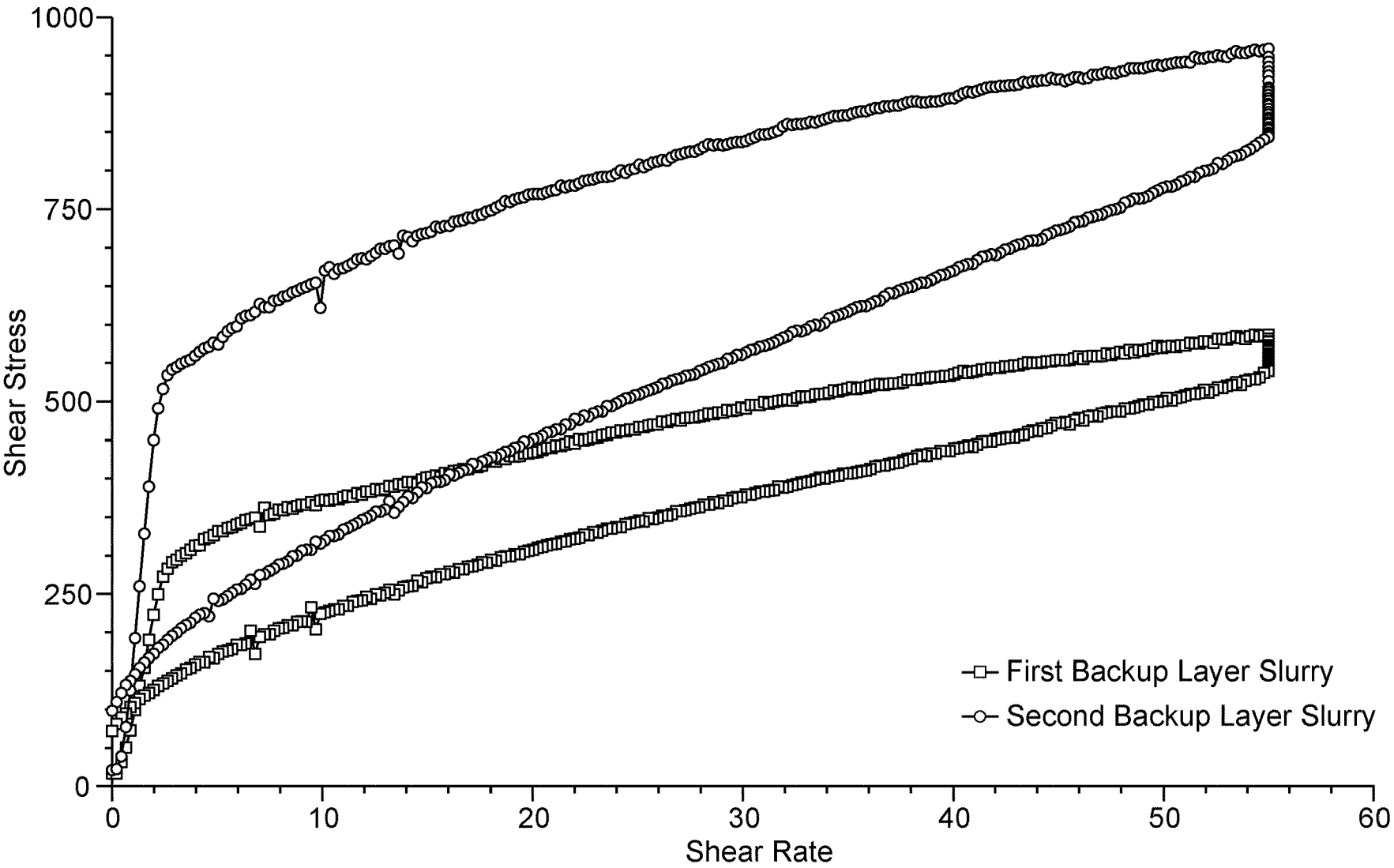
FIG. 5 is a plot of experimental data showing slurry shear stress as a function of shear rate.

The viscosity of the first and second backup slurries were measured using the test method described above and the results are shown in FIG. 5. The viscosity at the onset of flow was also determined based on the measured viscosity at the time yield stress was first reached. The viscosity at the onset of low for the first and second backup slurries were determined to be 8608 cP and 20,236 cP, respectively.

Exemplary embodiments include the following:

Embodiment 1. A method of making an investment casting mold comprising:

coating a sacrificial pattern with a prime layer comprising a first refractory slurry and a first refractory stucco;

at least partially hardening the prime layer;

coating the prime layer with an intermediate layer comprising a second refractory slurry and a second refractory stucco;

at least partially hardening the intermediate layer;

coating the intermediate layer with a first backup layer comprising a first thixotropic agent, the first thixotropic agent comprising a first polymer emulsion;

coating the first backup layer with a second backup layer comprising a second thixotropic agent, the second thixotropic agent comprising a second polymer emulsion; and at least partially hardening the first backup layer and the second backup layer.

Embodiment 2. The method of embodiment 1, wherein at least partially hardening the first backup layer and the second backup layer comprises:

at least partially hardening the first backup layer prior to coating the first backup layer with the second backup layer; and at least partially hardening the second backup layer.

Embodiment 3. The method of any one of embodiments 1 to 2, further comprising coating the second backup layer with a seal layer.

Embodiment 4. The method of embodiment 3, wherein the seal layer comprises at least one of fused silica, alumino-silicate, zircon, or aluminum oxide.

Embodiment 5. The method of any one of embodiments 1 to 4, wherein the first backup layer further comprises a refractory stucco comprising at least one of fused silica, alumino-silicate, zircon, or aluminum oxide.

Embodiment 6. The method of any one of embodiments 1 to 5, wherein the second backup layer further comprises a refractory stucco comprising at least one of fused silica, alumino-silicate, zircon, or aluminum oxide.

Embodiment 7. The method of any one of embodiments 1 to 6, wherein the polymer emulsion of the first thixotropic agent of the first backup layer comprises an aqueous emulsion.

Embodiment 8. The method of any one of embodiments 1 to 7, wherein the polymer emulsion of the second thixotropic agent of the second backup layer comprises an aqueous emulsion.

Embodiment 9. The method of any one of embodiments 1 to 8, wherein the polymer emulsion of the first thixotropic agent of the first backup layer comprises an alkali-swellable polymer.

Embodiment 10. The method of any one of embodiments 1 to 9, wherein the polymer emulsion of the second thixotropic agent of the second backup layer comprises an alkali-swellable polymer.

Embodiment 11. The method of any one of embodiments 1 to 10, wherein the first polymer emulsion is present in an amount ranging from 0.07 weight percent to 0.75 weight percent based on the overall weight of the first backup layer.

Embodiment 12. The method of any one of embodiments 1 to 11, wherein the second polymer emulsion is present in an amount ranging from 0.07 weight percent to 0.75 weight percent based on the overall weight of the second backup layer.

Embodiment 13. The method of any one of embodiments 1 to 12, wherein each of the first backup layer and second backup layer further comprises:

a refractory material;
a binder; and
a solvent.

Embodiment 14. The method of embodiment 13, wherein each of the first backup layer and second backup layer comprises an overall solids content ranging from 50 weight percent to 80 weight percent, based on the overall weight of the composition.

Embodiment 15. The method of any one of embodiments 1 to 14, wherein each of the first backup layer and the second backup layer comprises a viscosity at the onset of flow of at least 50 poise and no greater than 12,000 poise.

Embodiment 16. The method of any one of embodiments 1 to 15, wherein the first backup layer comprises a first viscosity at the onset of flow and the second backup layer comprises a second viscosity at the onset of flow, wherein the first viscosity is less than the second viscosity.

Embodiment 17. The method of embodiment 16, wherein the first viscosity is equal to at least 0.1 times the second viscosity and no greater than 0.7 times the second viscosity.

Embodiment 18. The method of any one of embodiments 1 to 17, wherein the first backup layer comprises a first yield stress at the onset of flow and the second backup layer comprises a second yield stress at the onset of flow, wherein the first yield stress is less than the second yield stress.

Embodiment 19. The method of any one of embodiments 1 to 18, wherein the investment casting mold has a non-fired modulus of rupture ranging from 250 psi to 700 psi after being fully hardened as measured utilizing ASTM C674-88 (2006).

All patents and patent applications mentioned above are hereby expressly incorporated by reference. Although the invention herein has been described with reference to particular embodiments, it is to be understood that these embodiments are merely illustrative of the principles and applications of the present invention. It will be apparent to those skilled in the art that various modifications and variations can be made to the method and apparatus of the present invention without departing from the spirit and scope of the invention. Thus, it is intended that the present invention include modifications and variations that are within the scope of the following claims and their equivalents.

What is claimed is:

1. A method of making an investment casting mold comprising:

coating a sacrificial pattern with a prime layer comprising a first refractory slurry and a first refractory stucco;

at least partially hardening the prime layer;

coating the prime layer with an intermediate layer comprising a second refractory slurry and a second refractory stucco;

at least partially hardening the intermediate layer;

coating the intermediate layer with a first backup layer comprising a first thixotropic agent, the first thixotropic agent comprising a first polymer emulsion;

coating the first backup layer with a second backup layer comprising a second thixotropic agent, the second thixotropic agent comprising a second polymer emulsion; and at least partially hardening the first backup layer and the second backup layer;

wherein the first backup layer comprises a first yield stress at the onset of flow and the second backup layer comprises a second yield stress at the onset of flow, wherein the first yield stress is less than the second yield stress; and wherein the first backup layer comprises a first viscosity at the onset of flow and the second backup layer comprises a second viscosity at the onset of flow, wherein the first viscosity is equal to at least 0.1 times the second viscosity and no greater than 0.7 times the second viscosity.

2. The method of claim 1, wherein at least partially hardening the first backup layer and the second backup layer comprises:

at least partially hardening the first backup layer prior to coating the first backup layer with the second backup layer; and at least partially hardening the second backup layer.

3. The method of claim 1, further comprising coating the second backup layer with a seal layer.

4. The method of claim 3, wherein the seal layer comprises at least one of fused silica, alumino-silicate, zircon, or aluminum oxide.

5. The method of claim 1, wherein the first backup layer further comprises a refractory stucco comprising at least one of fused silica, alumino-silicate, zircon, or aluminum oxide.

6. The method of claim 1, wherein the second backup layer further comprises a refractory stucco comprising at least one of fused silica, alumino-silicate, zircon, or aluminum oxide.

7. The method of claim 1, wherein the polymer emulsion of the first thixotropic agent of the first backup layer comprises an aqueous emulsion.

8. The method of claim 1, wherein the polymer emulsion of the second thixotropic agent of the second backup layer comprises an aqueous emulsion.

9. The method of claim 1, wherein the polymer emulsion of the first thixotropic agent of the first backup layer comprises an alkali-swellable polymer.

10. The method of claim 1, wherein the polymer emulsion of the second thixotropic agent of the second backup layer comprises an alkali-swellable polymer.

11. The method of claim 1, wherein the first polymer emulsion is present in an amount ranging from 0.07 weight percent to 0.75 weight percent based on the overall weight of the first backup layer.

12. The method of claim 1, wherein the second polymer emulsion is present in an amount ranging from 0.07 weight percent to 0.75 weight percent based on the overall weight of the second backup layer.

13. The method of claim 1, wherein each of the first backup layer and second backup layer further comprises:

a refractory material;
a binder; and
a solvent.

14. The method of claim 13, wherein each of the first backup layer and second backup layer comprises an overall solids content ranging from 50 weight percent to 80 weight percent, based on the overall weight of the composition.

15. The method of claim 1, wherein each of the first backup layer and the second backup layer comprises a viscosity at the onset of flow of at least 50 poise and no greater than 12,000 poise.

16. The method of claim 1, wherein the investment casting mold has a non-fired modulus of rupture ranging from 250 psi to 700 psi after being fully hardened as measured utilizing ASTM C674-88 (2006).

* * * * *